US006309785B1

(12) United States Patent
Qi et al.

(10) Patent No.: US 6,309,785 B1
(45) **Date of Patent: *Oct. 30, 2001**

(54) IMAGING MEMBERS

(75) Inventors: Yu Qi; Beng S. Ong; Ping Liu, all of Mississauga; C. Geoffrey Allen, Waterdown, all of (CA)

(73) Assignee: Xerox Corporation, Stamford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/698,042

(22) Filed: Oct. 30, 2000

(51) Int. Cl.[7] ..... G03G 5/087
(52) U.S. Cl. ..... 430/58.8; 430/59.6; 430/126
(58) Field of Search ..... 430/56, 58.05, 430/58.65, 66, 67, 58.8, 59.6, 126

(56) References Cited

U.S. PATENT DOCUMENTS

| | | | |
|---|---|---|---|
| 3,121,006 | 2/1964 | Middleton et al. | 96/1 |
| 3,871,882 | 3/1975 | Weidemann | 96/1.5 |
| 4,081,274 | 3/1978 | Horgan | 96/1 PC |
| 4,115,116 | 9/1978 | Stolka et al. | 96/1.5 R |
| 4,233,384 | 11/1980 | Turner et al. | 430/59 |
| 4,265,900 | 5/1981 | Rasmussen et al. | 424/273 R |
| 4,299,897 | 11/1981 | Stolka et al. | 430/59 |
| 4,304,829 | 12/1981 | Limburg et al. | 430/59 |
| 4,306,008 | 12/1981 | Pai et al. | 430/59 |
| 4,419,427 | 12/1983 | Graser et al. | 430/58 |
| 4,429,029 | 1/1984 | Hoffmann et al. | 430/57 |
| 4,587,189 | 5/1986 | Hor et al. | 430/59 |
| 4,869,988 | 9/1989 | Ong et al. | 430/59 |
| 4,937,164 | 6/1990 | Duff et al. | 430/59 |
| 4,946,754 | 8/1990 | Ong et al. | 430/58 |
| 5,139,910 | 8/1992 | Law et al. | 430/59 |
| 5,482,811 | 1/1996 | Keoshkerian et al. | 430/135 |
| 5,645,965 | 7/1997 | Duff et al. | 430/59 |
| 5,683,842 | 11/1997 | Duff et al. | 430/59 |
| 6,096,464 * | 8/2000 | Sundararajan et al. | 430/58.05 |
| 6,214,505 * | 4/2001 | Ong et al. | 430/58.65 |

* cited by examiner

*Primary Examiner*—John Goodrow
(74) *Attorney, Agent, or Firm*—Oliff & Berridge, PLC

(57) ABSTRACT

A photoconductive imaging member includes a photogenerating layer and a charge transport layer, wherein the charge transport layer contains charge transport components and a poly(imide-carbonate) binder of general structure (I) or general structure(II):

(I)

(II)

where A, B, and E are divalent linkages; D is a trivalent linkage in (I) and a tetravalent linkage in (II); and x and y are the mole fractions of the repeating units such that x+y is equal to 1. The poly(imide carbonates)s can be made by interfacial polycondensation of bischloroformate, bis(imidephenol) and bisphenol.

34 Claims, No Drawings

IMAGING MEMBERS

BACKGROUND OF THE INVENTION

1. Field of Invention

The present invention is generally directed to imaging members, such as photoconductive imaging members and which members are comprised of novel charge transport layer binders of, for example, poly(imide-carbonate)s. The aforementioned poly(imide-carbonate) binders can possess a number of advantages including, for example, resistance to mechanical and corrosive wears induced and caused by the application of the electrochemically aggressive bias charging roll (BCR), enhanced photoreceptor life with no compromise in electrical performance characteristics. When a BCR is utilized as the charging device, the photoreceptor surface is generally subject to severe chemical attacks from the corrosive species generated during charging, leading to severe photoreceptor surface wear during cleaning. The photoreceptors that utilize the poly(imide-carbonate)s of the present invention as the charge transport layer binders generally exhibit longer serviceable life such as for example two-fold life enhancement over those that utilize polycarbonate Z binder under similar BCR charging conditions. Various imaging and electrophotographic digital apparatus and processes can incorporate the members of the present invention and wherein the developed images obtained can be of high resolution, especially in, for example high speed, over about 65 prints/copies per minute, machines such as the Xerox Corporation 5090.

The present invention also describes a preparative process for the poly(imide-carbonate)s of the present invention via an interfacial polycondensation reaction using bischloroformates. One of the advantages of this synthetic process over the conventional phosgenation is the elimination of the use of hazardous phosgene or triphosgene that are generally employed in polycarbonate synthesis. The resulting poly (imide-carbonate)s obtained by this process possess an alternating imide and carbonate moieties, and therefore, possess better solubility in common coating solvents such as for example, methylene chloride and tetrahydrofuran, which are generally utilized in the fabrication of charge transport layers. As much as 25 mole percent of the imide functionality can be incorporated into the poly(imide-carbonate) structure without significantly lowering the solubility of the resulting poly(imide-carbonate)s. On the other hand, the poly(imide-carbonate)s prepared via the conventional interfacial phosgenation generally have low solubility. Even a 10 mole percent incorporation of the imide functionality in the poly(imide-carbonate) structure leads to dramatically decreased solubility in the above-mentioned coating solvents.

2. Description of Related Art

Generally, layered photoresponsive imaging members are described in a number of U.S. patents, such as U.S. Pat. No. 4,265,900, the entire disclosure of which is incorporated herein by reference, wherein there is illustrated an imaging member comprised of a photogenerating layer, and an aryl amine hole transport layer. For example, charge transport layers comprised of aryl diamines dispersed in polycarbonates, like MAKROLON® are known. Examples of photogenerating layer components include trigonal selenium, metal phthalocyanines, vanadyl phthalocyanines, and metal free phthalocyanines. Additionally, there is described in U.S. Pat. No. 3,121,006 a composite xerographic photoconductive member comprised of finely divided particles of a photoconductive inorganic compound dispersed in an electrically insulating organic resin binder. The binder materials disclosed in the '006 patent can comprise resins that are substantially incapable of transporting for any significant distance, injected charge carriers generated by the photoconductive particles.

There are also disclosed in U.S. Pat. No. 3,871,882 photoconductive substances comprised of specific perylene-3,4,9,10-tetracarboxylic acid derivatives. In accordance with the teachings of this patent, the photoconductive layer is preferably formed by vapor depositing the perylene derivatives in a vacuum. Also, there is specifically disclosed in this patent dual layer photoreceptors with perylene-3,4,10-tetracarboxylic acid diimide derivatives, which have spectral response in the wavelength region of from 400 to 600 nanometers. Further, in U.S. Pat. No. 4,555,463, the entire disclosure of which is incorporated herein by reference, there is illustrated a layered imaging member with a chloroindium phthalocyanine photogenerating layer. In U.S. Pat. No. 4,587,189, the entire disclosure of which is incorporated herein by reference, there is illustrated a layered imaging member with a nonhalogenated perylene pigment photogenerating component. Both of the aforementioned patents disclose an aryl amine component as a hole transport layer and wherein there can be selected a resin binder.

Moreover, there are disclosed in U.S. Pat. No. 4,419,427 electrographic recording media with a photosemiconductive double layer comprised of a first layer containing charge carrier perylene diimide pigments, and a second layer with one or more compounds which are charge transporting materials when exposed to light.

U.S. Pat. No. 4,419,427 discloses the use of highly-loaded dispersions of perylene bisimides, with bis(2,6-dichlorophenylimide) being a preferred material, in binder resins as charge generating layers in devices overcoated with a charge transporting layer such as a poly(vinylcarbazole) composition. U.S. Pat. No. 4,429,029 illustrates the use, in devices similar to those of the '427 patent, of bisimides and bisimidazo perylenes in which the perylene nucleus is halogenated, preferably to an extent where 45 to 75 percent of the perylene ring hydrogens have been replaced by halogen. U.S. Pat. No. 4,587,189, the entire disclosure of which is incorporated herein by reference, illustrates layered photoresponsive imaging members prepared with highly-loaded dispersions or, preferably, vacuum evaporated thin coatings of cis- and trans-bis(benzimidazo)perylene (4a, X=1,2-phenylene) and other perylenes overcoated with hole transporting compositions comprised of a variety N,N,N',N'-tetraaryl-4,4'-diaminobiphenyls. U.S. Pat. No. 4,937,164 illustrates the use of perylene bisimides and bisimidazo pigments in which the 1,12-and/or 6,7 position of the perylene nucleus is bridged by one or two sulfur atoms wherein the pigments in the charge generating layers are either vacuum evaporated or dispersed in binder resins and a layer of tetraaryl biphenyl hole transporting molecules.

In U.S. Pat. Nos. 4,869,988 and 4,946,754, the entire disclosures of which are incorporated herein by reference, there are described layered photoconductive imaging members with transport layers incorporating, for example, biarylyl diarylamines, N,N-bis(biarylyl)anilines, and tris (biarylyl)amines as charge transport compounds. In the above-mentioned patents, there are disclosed improved layered photoconductive imaging members comprised of a supporting substrate, a photogenerating layer optionally dispersed in an inactive resinous binder, and in contact therewith a charge transport layer comprised of the above-mentioned charge transport compounds, or mixtures thereof dispersed in resinous binders.

It is also indicated in the aforementioned patents that there may be selected as resin binders for the charge transport molecules those components as illustrated in U.S. Pat. No. 3,121,006 including polycarbonates, polyesters, epoxy resins, polyvinylcarbazole; and also wherein for the preparation of the charge transport layer with a polycarbonate there is selected methylene chloride as a solvent.

SUMMARY OF THE INVENTION

Although imaging members with various charge transport layers, especially hole transport layer materials with hole transport molecules including the aryl amines dispersed in resinous binders such as polycarbonates, have been disclosed in the art, and are suitable for their intended purposes, a need remains for improving imaging members, particularly layered members, with chemically and mechanically robust transport layers, especially while the aggressive BCR is used as a charging device. Further, there continues to be a need for layered imaging members wherein the layers are sufficiently adhered to one another to allow the continuous use of such members in repetitive imaging systems without layer separation. Also, there continues a need for improved layered imaging members comprised of hole transport layers wherein the problems of transport molecule crystallization, bleeding and leaching are avoided or minimized. Furthermore, there is a need for imaging members that can be fabricated using nontoxic coating solvents, and wherein the resulting imaging members are inert to the users thereof. A further need resides in the provision of photoconductive imaging members with desirable mechanical characteristics. These and other needs may be accomplished, it is believed, in embodiments of the present invention.

A further need resides in the provision of imaging members containing charge transport layers with improved xerographic electrical performance including higher charge acceptance, lower dark decay, increased charge generation efficiency, reduced residual charge and/or reduced erase energy, improved long-term cycling performance, and less variability in performance with respect to environmental changes in temperature and humidity. A still further need is the provision of photoconductive imaging members whose transport layer binders provide the required xerographic and mechanical performance characteristics. These and other needs may be accomplished, it is believed, in embodiments of the present invention.

Examples of features of the present invention include:

It is a feature of the present invention to provide photoconductive imaging members.

It is another feature of the present invention to provide imaging members containing novel charge transport layers.

It is another feature of the present invention to provide photoconductive imaging members with photosensitivity in both the visible and infrared wavelength regions of light spectrum, such as from about 400 to about 900 nanometers.

Still another feature of the present invention relates to the provision of novel transport layer binders, and more specifically, poly(imide-carbonate) binders.

DETAILED DESCRIPTION OF PREFERRED EMBODIMENTS

Aspects of the present invention relate to photoconductive imaging members comprised of a charge transport layer in contact with a photogenerating layer, and wherein the charge transport components, such as charge transport molecules are dispersed in a poly(imide-carbonate) binder. According to the present invention, the photoconductive imaging members can have any of a variety of layered structures, as are known in the art and as demonstrated in the above-cited references. For example, the photoconductive imaging members can include one or more of the various known layers including, but not limited to, an anti-curl back coating layer, a supporting substrate, a conductive substrate, an electrically conductive ground plane, a blocking layer, an adhesive layer, an overcoat layer, and the like. The photoconductive imaging members also generally include one or more charge transport layers and one or more charge generating layers, or include one or more combined charge transport and charge generating layers.

The photoconductive imaging members of the present invention can thus be comprised of a supporting substrate, a charge transport layer, and a photogenerator layer, and wherein the charge transport components, such as charge transport molecules, are dispersed in a poly(imide-carbonate) binder. The supporting substrate can be, for example, but is not limited to, a metal, a conductive polymer, or an insulating polymer, each with a thickness of from about 30 microns to about 500 microns. The supporting substrate can also optionally be overcoated with an electrically conductive layer, with an optional thickness of from about 0.01 micron to about 1 micron. If desired, the imaging member can further include an overcoating top layer on the member, which is preferably but not necessarily made of a polymer.

According to the photoconductive imaging members of the present invention, the photogenerator (charge generating) layer component is dispersed in a resinous binder in an amount of from about 5 percent to about 95 percent by weight. The resinous binder for the photogenerating layer can be, for example, but is not limited to, a polyester, a polyvinylcarbazole, a polyvinylbutyral, a polycarbonate, a polyethercarbonate, an aryl amine polymer, a styrene copolymer, or a phenoxy resin.

In a similar manner, the charge transport layer can be comprised of an amine in a poly(imide-carbonate) binder resin. For example, the charge transport layer can be comprised of molecules of the following formula dispersed in a poly(imide-carbonate):

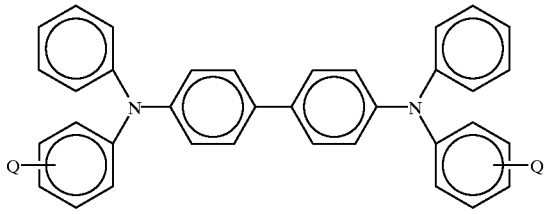

wherein Q is independently halide or alkyl. Although not limited thereto, the charge transport layer can be comprised of the aryl amine molecules dispersed in a poly(imide-carbonate) binder in an amount of from about 20 to about 60 percent.

The photoconductive imaging members generally include a photogenerating layer that is of a thickness of from about 0.2 to about 10 microns, a charge transport layer that is of a thickness of from about 10 to about 100 microns, and wherein the supporting substrate is overcoated with a polymeric adhesive layer of a thickness of from about 0.001 to about 1micron.

The photoconductive imaging members of the present invention can advantageously be used in conventional imaging methods as are known in the art, such as an imaging method comprising the formation of a latent image on the photoconductive imaging member, developing the image with a toner composition comprised of rresin and colorant, transferring the image to a substrate, and optionally fixing the image thereto.

Of importance to the present invention in embodiments thereof as the binders for the charge transport layers and optionally for the photogenerating layers, is a poly(imide-carbonate) represented by the general formula (I) or (II):

(I)

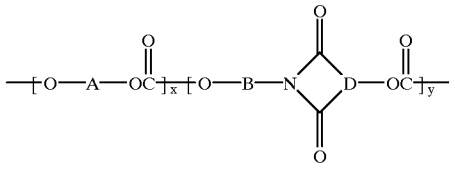

(II)

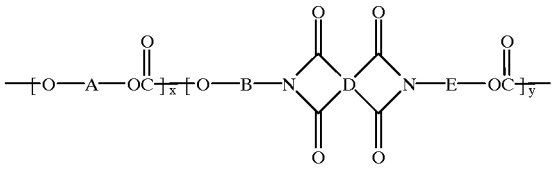

wherein A, B, and E are divalent linkages independently selected from the group consisting of alkylene, arylene, biarylene, alkylenearyl, and the like; D is a trivalent linkage in formula (I) and a tetravalent linkage in formula (II), preferably selected from the groups consisting of trivalent or tetravalent arene and cyclic alkane moieties, and the like; and x and y are the mole fractions of the repeating units such that x+y is equal to 1. Illustrative examples of trivalent and tetravalent arene and cyclic alkane moieties include, but are not limited to, the following groups:

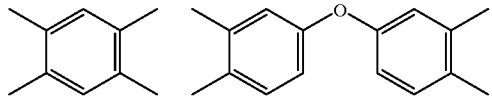

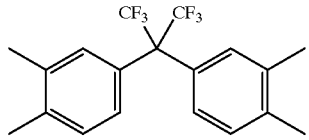

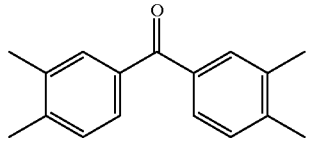

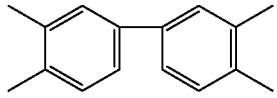

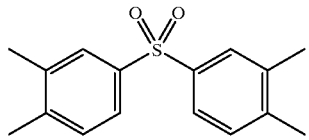

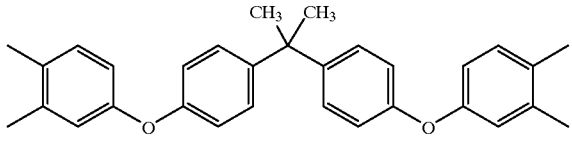

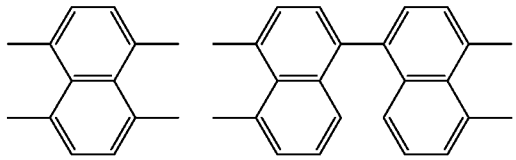

-continued

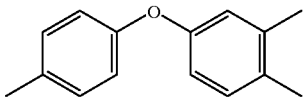

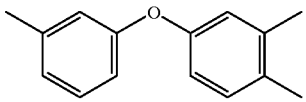

-continued

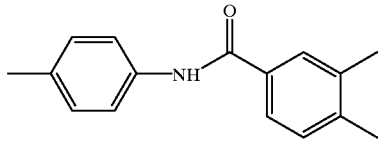

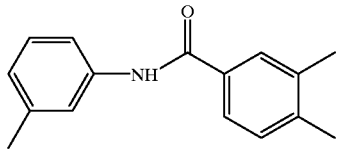

In embodiments the preferred poly(imide-carbonate) binders for the charge transport layers of the imaging members of the present invention are represented by the general formula (III):

(III)

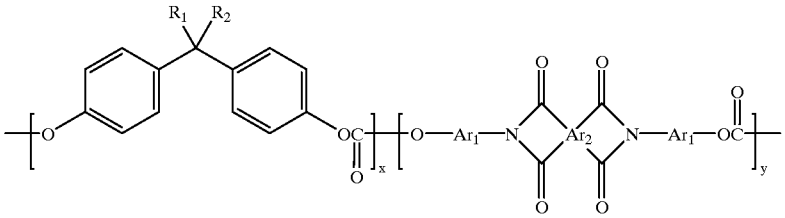

wherein x and y are the molar fractions of the repeating monomer units such that the sum of x+y equals to 1; $R_1$ and $R_2$ are selected from the group consisting of hydrogen, alkyl, substituted alkyl, aryl, substituted aryl, and the like, wherein alkyl and substituted alkyl contain from about one to about 15 carbon atoms and aryl and substituted aryl contain from about six to about 40 carbon atoms; $Ar_1$ is an arylene group or a substituted arylene group with the substituents being, for example, methyl, ethyl, propyl, butyl, pentyl, hexyl, heptyl, octyl, nonyl, decyl, methoxy, ethoxy, propoxy, and the like; $Ar_2$ is a tetravalent aromatic linkage, preferably including, but not limited to, monocyclic aromatic linkages such as those derived from pyromellitic acid, and bicyclic linkages including for example those derived from the biphenyl-, benzophenone-, diphenyl sulfide, diphenyl sulfone tetracarboxylic acids, and others deriving from 2,2-bis(4-(dicarbonsyphenoxy) phenyl)propanetetracarbonxylic acids, particularly 3,4-dicarboxyphenoxylic acids. Preferably, in embodiments, x ranges from about 0.50 to about 0.99, and y ranges from about 0.01 to about 0.50, although values outside these ranges can be used.

-continued

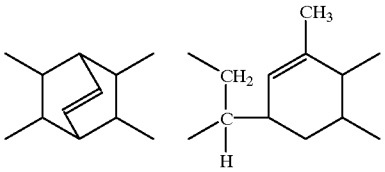

Illustrative examples of poly(imide-carbonates) are (IIIa) through (IIIj):

(IIIa)
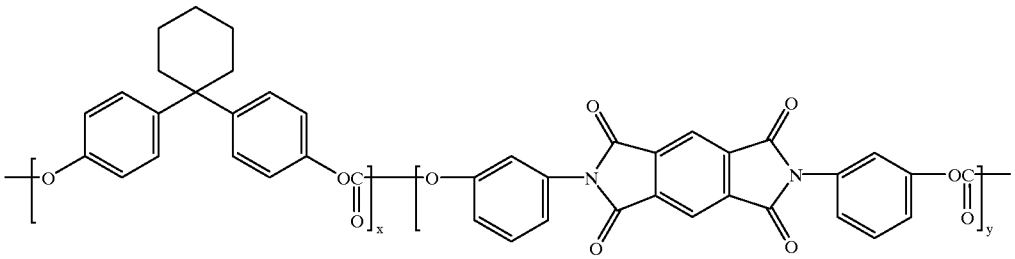
(IIIb)
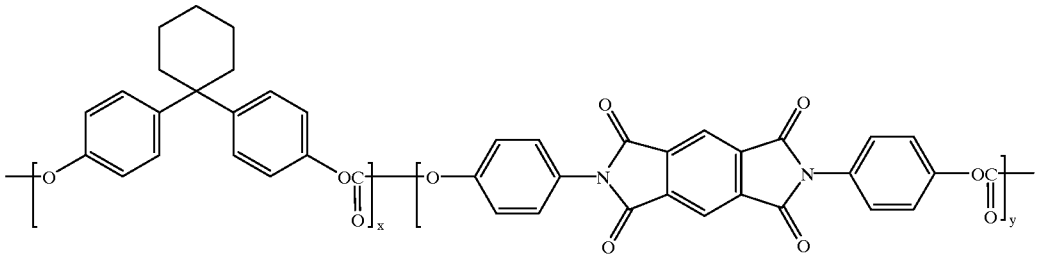
(IIIc)
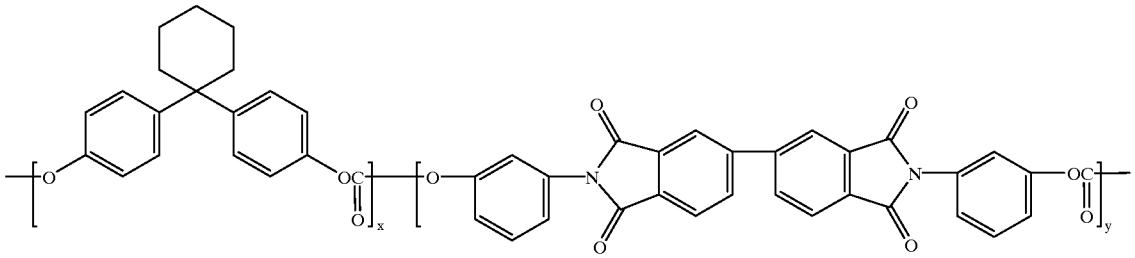
(IIId)
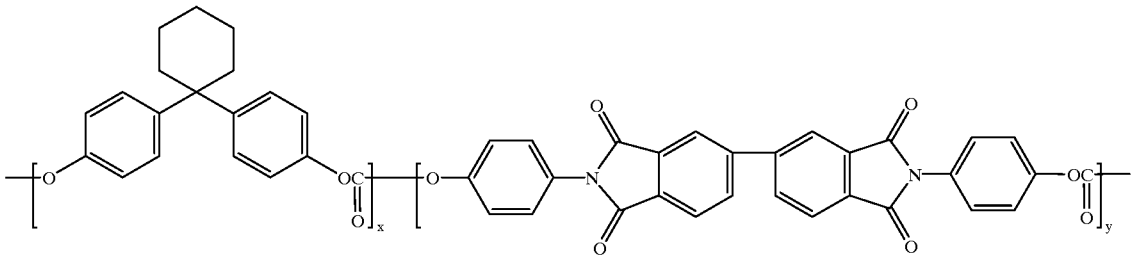
(IIIe)
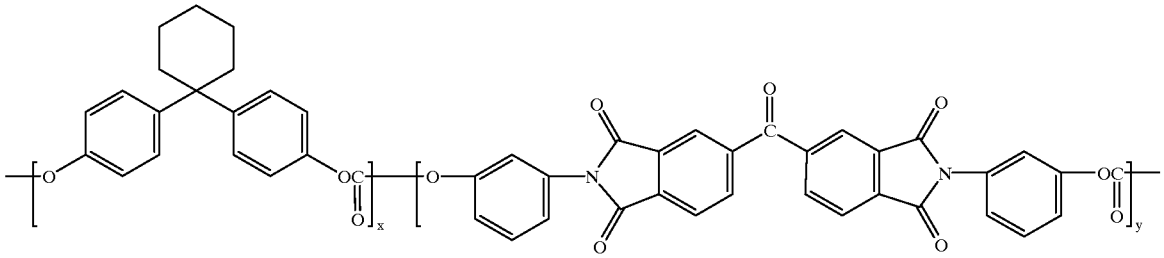

-continued (IIIf)

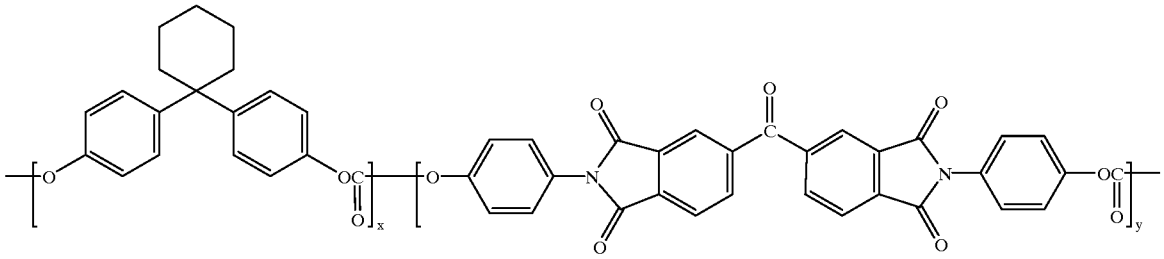

(IIIg)

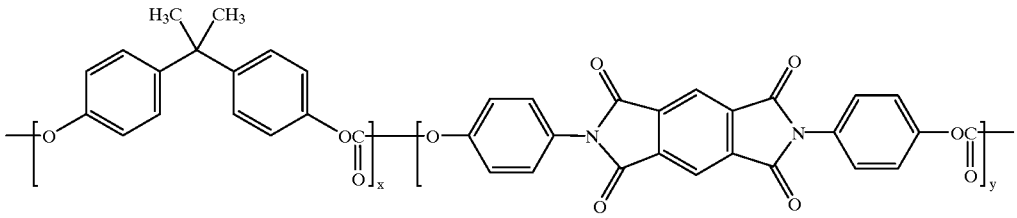

(IIIh)

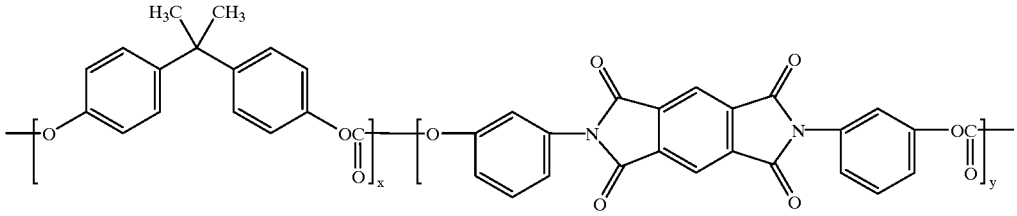

(IIIi)

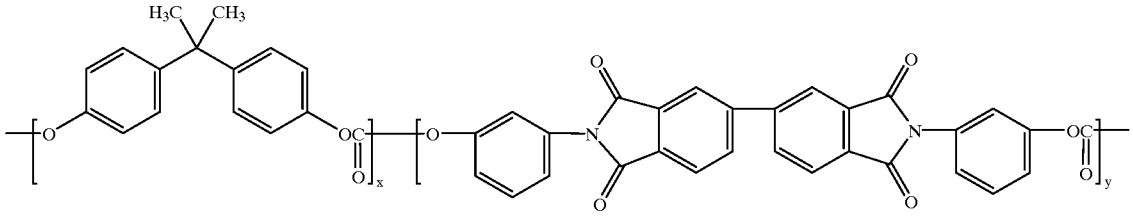

(IIIj)

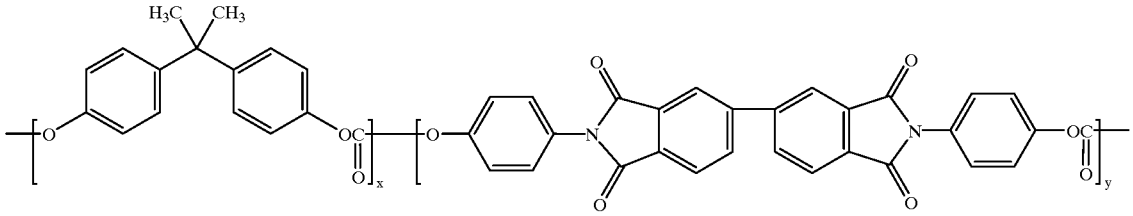

where x and y are as defined above.

Useful weight average molecular weights, Mw, of the poly(imide-carbonate) (III) ranges, for example, from about 30,000 to about 500,000, preferably from about 50,000 to about 150,000. Useful number average molecular weights, Mn, of the poly(imide-carbonate) (III) ranges from about 5,000 to about 100,000, preferably from about 10,000 to about 70,000. Although weights outside of these ranges can be used, in embodiments.

Of importance to the present invention in embodiments thereof is that the poly(imide-carbonate) (III) is prepared by interfacial polycondensation with bischloroformate IV, bis (imidephenol) V and bisphenol VI as illustrated in Scheme 1. This preparative process not only eliminates the use of hazardous chemicals, such as phosgene and triphosgene, it also provides an alternate imide-carbonate structure in the resultant polymer. The poly(imide-carbonate)s having the alternate imide-carbonate structure as synthesized by this process exhibit higher solubility in common coating solvents such as for example tetrahydrofuran, methylene chloride, and chlorobenzene, even with a high imide content of for example 25 mole percent in the poly(imide-carbonate). Accordingly, the transport layers using the poly (imide-carbonate) binders of the present invention can be easily processed in common coating solvents.

Scheme 1

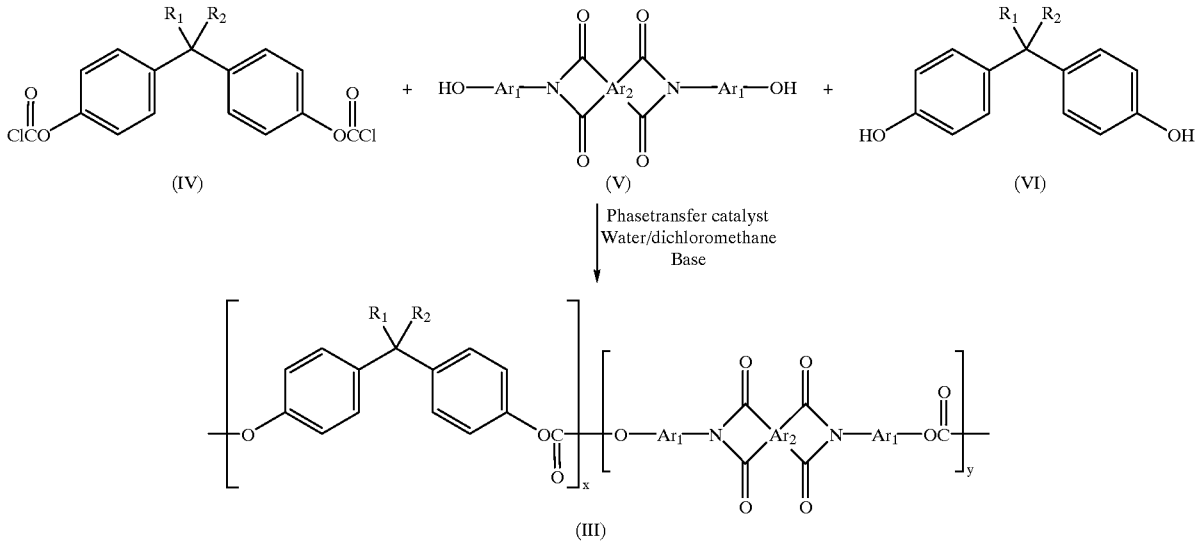

wherein $R_1$, $R_2$, $Ar_1$ and $Ar_2$, x and y are as defined herein before.

A general preparative procedure for the poly(imide-carbonate) of the present invention is given below as an illustration.

A mixture of bis(imidephenol) monomer V, an aqueous alkaline solution such as, aqueous sodium hydroxide solution, an organic solvent such as dichloromethane, and a suitable phase transfer catalyst such as benzyltriethylammonium chloride is stirred at room temperature of about 25° C. To the mixture is added a solution of bischloroformate dichloromethane (IV) such as 4,4-cyclohexylidenebisphenol bischloroformate in methylene chloride over a period of about 1 minute to about 60 minutes. An amine catalyst such as triethylamine, tributyl amine or the like, can be added to accelerate the reaction, if desired. A solution of bisphenol (VI) in an aqueous alkaline solution such as, aqueous sodium hydroxide solution, is added into the mixture over a period of about 1 minute to about 60 minutes. An access of alkaline solution may be required to increase the molecular weight at the end of the reaction. The interfacial polycondensation is generally accomplished at a temperature of from 0° C. to 100° C., preferably from about 25° C. to 50° C. The reaction time is generally from about 10 minutes to about 5 hours depending on the required final molecular weight of polymer. After the reaction, the organic layer can be separated and washed, for example, with dilute hydrochloric acid and water. The poly(imide-carbonate) product is precipitated from methanol, and purified by dissolving in an organic solvent, such as dichloromethane or tetrahydrofuran, and can then optionally be precipitated again from methanol. The precipitation procedure can be repeated twice to obtain pure poly(imide-carbonate), and can be filtered and dried in vacuo. The poly(imide carbonate) is suitable for use as charge transporting binders. The poly(imide-carbonate) structure can be characterized by NMR and IR spectroscopy. The number and weight average molecular weights of the polymer can be determined, for example, by a Waters Gel Permeation Chromatograph employing four ULTRASTYRAGEL® columns with pore sizes of 100, 500, 500, and 104 Angstroms and using tetrahydrofuran as a solvent.

Illustrative examples of bischloroformate (IV) that can be selected for the preparation of poly(imide-carbonate) (III) include, but are not limited to, bisphenol bischloroformate, bis(hydroxyphenyl)methane bischloroformate, bis(hydroxyphenyl)dimethylmethane bischloroformate, bis(hydroxyphenyl)cyclohexane bischloroformate and the like.

Illustrative examples of bis(imidephenol) monomer (V) include, but are not limited to:

(Va)

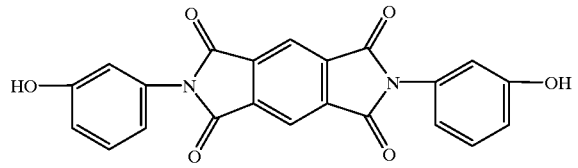

(Vb)

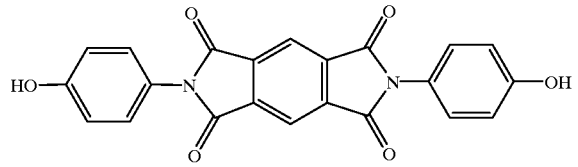

(Vc)

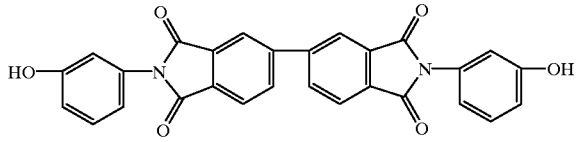

-continued (Vd)

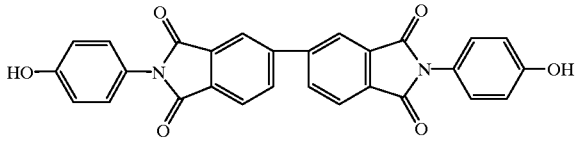

(Ve)

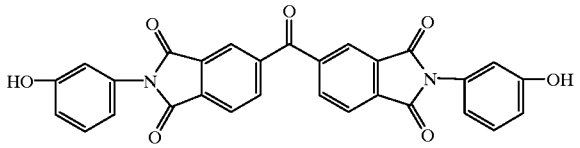

(Vf)

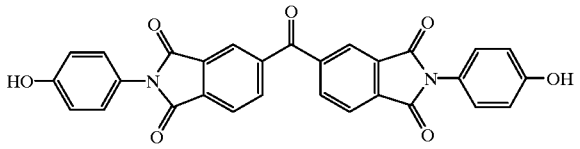

Illustrative examples of bisphenol monomer (VI) include, but are not limited to, bisphenol, bis(hydroxyphenyl) methane, bis(hydroxyphenyl)dimethylmethane, bis (hydroxyphenyl)cyclohexane, and the like.

Generally, the poly(imide-carbonate) is present in the charge transport layer as a resin binder in various suitable amounts, such as for example from about 30 to about 80 percent by weight, and preferably from about 50 to about 75 percent by weight with respect to the charge transport molecule. Although amounts outside of these ranges can be used, in embodiments.

In embodiments, the imaging members of the present invention generally possess broad spectral response to white light or, specifically to red, green and blue light emitting diodes and stable electrical properties over long cycling times. Many of the imaging members of the present invention can exhibit excellent charge acceptance of over about 800 volts surface potential in a layered device, dark decay of less than about 50 volts per second, for example about 5 to about 45 volts per second, good photosensitivity ranging from $E_{1/2}$ of less than about 3 ergs/cm$^2$, for example about 2.5, to about 20 ergs/cm$^2$. Further, the imaging members of the present invention can selected with red, blue and green LED lasers, for digital systems, and for upgraded visible light systems and machines. The imaging members of the present invention are comprised, for example, of preferably in the order indicated, a conductive substrate, a photogenerating layer consisting of a photogenerating pigment dispersed in a resinous binder composition, and a charge transport layer, which comprises charge transporting molecules dispersed in a poly(imide-carbonate); or a member comprised of a conductive substrate, a hole blocking metal oxide layer, an optional adhesive layer, a photogenerating layer optionally dispersed in a resinous binder composition, and an aryl amine hole transport layer comprising aryl amine hole transport molecules dispersed in a poly(imide-carbonate) resinous binder.

The substrate can be comprised of any suitable component. For example it can be formulated entirely of an electrically conductive material, or it can be comprised of an insulating material having an electrically conductive surface. The substrate can be of an effective thickness, generally up to about 100 mils, and preferably from about 1 to about 50 mils, although the thickness can be outside of this range. The thickness of the substrate layer depends on many factors, including economic and mechanical considerations. Thus, this layer may be of substantial thickness, for example over 100 mils, or of minimal thickness provided that there are no adverse effects thereof. In a particularly preferred embodiment, the thickness of this layer is from about 3 mils to about 10 mils. The substrate can be opaque or substantially transparent and can comprise numerous suitable materials having the desired mechanical properties. The entire substrate can comprise the same material as that in the electrically conductive surface, or the electrically conductive surface can merely be a coating on the substrate. Any suitable electrically conductive material can be employed. Typical electrically conductive materials include copper, brass, nickel, zinc, chromium, stainless steel, conductive plastics and rubbers, aluminum, semitransparent aluminum, steel, cadmium, titanium, silver, gold, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. The substrate layer can vary in thickness over substantially wide ranges depending on the desired use of the photoconductive member. Generally, the conductive layer ranges in thickness of from about 50 Angstroms to about 100 centimeters, although the thickness can be outside of this range. When a flexible electrophotographic imaging member is desired, the thickness typically is, for example, from about 100 Angstroms to about 750 Angstroms. The substrate can be of any other conventional material, including organic and inorganic materials, such as insulating nonconducting materials such as various resins known for this purpose including polycarbonates, polyamides, polyurethanes, paper, glass, plastic, polyesters, such as MYLAR® (available from E.I. DuPont) or MELINEX 447® (available from ICI Americas, Inc.), and the like. If desired, a conductive substrate can be coated onto an insulating material. In addition, the substrate can comprise a metallized plastic, such as titanized or aluminized MYLAR®, wherein the metallized surface is in contact with the photogenerating layer or any other layer situated between the substrate and the photogenerating layer. The coated or uncoated substrate can be flexible or rigid, and can have any number of configurations, such as a plate, a cylindrical drum, a scroll, an endless flexible belt, or the like. The outer surface of the substrate preferably comprises a metal oxide such as aluminum oxide, nickel oxide, titanium oxide, and the like.

An optional intermediate adhesive layer may be situated between the substrate and subsequently applied layers to, for example, improve adhesion. When such adhesive layers are utilized, they preferably have a dry thickness of, for example, from about 0.1 micron to about 5 microns, although the thickness can be outside of this range. Typical adhesive layers include film-forming polymers such as polyester, polyvinylbutyral, polyvinylpyrrolidone, polycarbonate, polyurethane, polymethylmethacrylate, and the like as well as mixtures thereof. Since the surface of the substrate can be a metal oxide layer or an adhesive layer, the expression substrate is intended to also include a metal oxide layer with or without an adhesive layer on a metal oxide layer. Moreover, other known layers may be selected for the photoconductive imaging members of the present invention, such as polymer protective overcoats, a blocking layer usually situated on the substrate, and the like.

The photogenerating layer is of an effective thickness, for example, of from about 0.05 micron to about 10 microns or more, and in embodiments has a thickness of from about 0.1 micron to about 3 microns. The thickness of this layer can be pendent primarily upon the concentration of photogenerating material in the layer, which may generally vary from about 5 to 100 percent. The 100 percent value generally occurs when the photogenerating layer is prepared by vacuum evaporation of the pigment. When the photogenerating material is present in a binder material, the binder contains, for example, from about 25 to about 95 percent by weight of the photogenerating material, and preferably contains about 60 to 80 percent by weight of the photogenerating material. Generally, it is desirable to provide this layer in a thickness sufficient to absorb about 90 to about 97 percent or more of the incident radiation which is directed upon it in the imagewise or printing exposure step. The maximum thickness of this layer is dependent primarily upon factors, such as mechanical considerations, such as the specific photogenerating compound selected, the thicknesses of the other layers, and whether a flexible photoconductive imaging member is desired.

Hole transport molecules of the type described in, for example, U.S. Pat. Nos. 4,306,008; 4,304,829; 4,233,384; 4,115,116; 4,299,897; 4,081,274, and 5,139,910, the entire disclosures of each are incorporated herein by reference, can be selected for the imaging members of the present invention. Typical diamine hole transport molecules include N,N'-diphenyl-N,N'-bis(3-methylphenyl)-(1,1'-biphenyl)-4,4'-diamine, N,N'-diphenyl-N,N'-bis(4-methylphenyl)-(1,1'-biphenyl)-4,4'-diamine, N,N'-diphenyl-N,N'-bis(2-methylphenyl)-(1,1'-biphenyl)-4,4'-diamine, N,N'-diphenyl-N,N'-bis(3-ethylphenyl)-(1,1'-biphenyl)-4,4'-diamine, N,N'-diphenyl-N,N'-bis(4-ethylphenyl)-(1,1'-biphenyl)-4,4'-diamine, N,N'-diphenyl-N,N'-bis(4-n-butylphenyl)-(1,1'-biphenyl)-4,4'-diamine, N,N'-diphenyl-N,N'-bis(3-chlorophenyl)-(1'-biphenyl)-4,4'-diamine, N,N'-diphenyl-N,N'-bis(4-chlorophenyl)-(1,1'biphenyl)-4,4'-diamine, N,N'-diphenyl-N,N'-bis(phenylmethyl)-(1,1'-biphenyl)-4,4'-diamine, N,N,N',N'-tetraphenyl-[2,2'-dimethyl-1,1'-biphenyl]-4,4'-diamine, N,N,N',N'-tetra-(4-methylphenyl)-[2,2'-dimethyl-1,1'-biphenyl]-4,4'-diamine, N,N'-diphenyl-N,N'-bis(4-methylphenyl)-[2,2'-dimethyl-1,1'-biphenyl]-4,4'-diamine, N,N'-diphenyl-N,N'-bis(2-methylphenyl)-[2,2'-dimethyl-1,1'-biphenyl]-4,4'-diamine, N,N'-diphenyl-N,N'-bis(3-methylphenyl)-[2,2'-dimethyl-1,1'-biphenyl]-4,4'-diamine, N,N'-diphenyl-N,N'-bis(3-methylphenyl)-pyrenyl-1,6-diamine, and the like.

In embodiments of the present invention, the preferred hole transport layer, since it enables excellent effective transport of charges, is comprised of aryldiamine components as represented, or essentially represented, by the general formula of, for example, the U.S. patents indicated herein, such as U.S. Pat. No. 4,265,990, wherein X, Y and Z are selected from the group consisting of hydrogen, an alkyl group with, for example, from 1 to about 25 carbon atoms and a halogen, preferably chlorine, and at least one of X, Y and Z is independently an alkyl group or chlorine. When Y and Z are hydrogen, the compound may be N,N'-diphenyl-N,N'-bis(alkylphenyl)-(1,1'-biphenyl)-4,4'-diamine wherein alkyl is, for example, methyl, ethyl, propyl, n-butyl, or the like, or the compound may be N,N'-diphenyl-N,N'-bis(chlorophenyl)-(1,1'-biphenyl)-4,4'-diamine.

The charge transport component is present in the charge transport layer in an effective amount, generally from about 5 to about 90 percent by weight, preferably from about 20 to about 75 percent by weight, and more preferably from about 30 to about 60 percent by weight, although the amount can be outside of this range.

Examples of the highly insulating and transparent resinous components or inactive binder resinous material for the photogenerating layer include binders such as those described in U.S. Pat. No. 3,121,006, the entire disclosure of which is incorporated herein by reference. Specific examples of suitable organic resinous materials include polycarbonates, acrylate polymers, vinyl polymers, cellulose polymers, polyesters, polysiloxanes, polyamides, polyurethanes, polystyrenes, and epoxies as well as block, random or alternating copolymers thereof. Preferred electrically inactive binder materials are polycarbonate resins having a molecular weight of form about 20,000 to about 100,000 with a molecular weight in the range of from about 50,000 to about 100,000 being particularly preferred. Particularly preferred electrically inactive binder materials are the poly(imide carbonate) resins, described in greater detail above. Generally, the resinous binder contains from about 20 to about 100 percent by weight of the photogenerating pigment and preferably from about 80 percent to about 90 weight percent. Also, the binder for the photogenerating layer can be the poly(imidecarbonates) illustrated herein.

The photoconductive imaging member may optionally contain a charge blocking layer situated between the conductive substrate and the photogenerating layer. This layer may comprise metal oxides, such as aluminum oxide and the like, or materials such as silanes and nylons. Additional examples of suitable materials include polyisobutyl methacrylate, copolymers of styrene and acrylates such as styrene/n-butyl metacylate, copolymers of styrene and vinyl toluene, polycarbonates, alkyl substituted polystyrenes, styrene-olefin copolymers, polyesters, polyurethanes, polyterpenes, silicone elastomers, mixtures thereof, copolymers thereof, and the like. The primary purpose of this layer is to prevent charge injection from the substrate during and after charging. This layer is of a thickness of less than 50 Angstroms to about 10 microns, preferably being no more than about 2 microns.

In addition, the photoconductive imaging member may also optionally contain a second adhesive interface layer situated between the hole blocking layer and the photogenerating layer. This layer may comprise a polymeric material such as polyester, polyvinyl butyral, polyvinyl pyrrolidone and the like. Typically, this layer thickness of less than about 0.6 micron.

There are illustrated in U.S. Pat. No. 5,645,965, the entire disclosure of which is incorporated herein by reference, photoconductive imaging members with symmetrical dimeric perylenes, and in U.S. Pat. No. 5,683,842, the entire disclosure of which is incorporated herein by reference, photoconductive imaging members with unsymmetrical dimeric perylenes. In U.S. Pat. Nos. 5,521,064 and 5,482,811, the entire disclosures of which are incorporated herein by reference, there are illustrated imaging members with photogenerating components of hydroxygallium phthalocyanines and aryl amine charge transport components. These patents also disclose resin binders for the photogenerating and charge transport components.

In copending U.S. patent application Ser. No. 09/165,595, the entire disclosure of which is incorporated herein by reference there is illustrated a photoconductive imaging member comprised of an unsymmetrical perylene of the formula

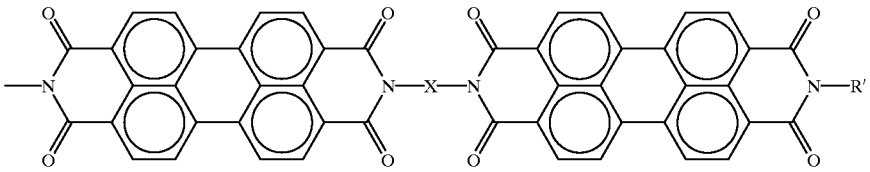

wherein each R and R' are dissimilar and wherein said R and R' are hydrogen, alkyl, cycloalkyl, substituted alkyl, aryl, substituted aryl, aralkyl, and substituted aralkyl, and X represents a symmetrical bridging component.

A number of the appropriate components of the imaging members of the above patents, such as the substrates, charge transport components, photogenerating pigments, and the like, can be selected for the imaging members of the present invention.

The present invention also encompasses imaging and printing devices and methods for generating images with the photoconductive imaging members disclosed herein. The method comprises the steps of generating an electrostatic latent image on a photoconductive imaging member of the present invention, developing the latent image with a toner comprised of resin, colorant like carbon black, and a charge additive, and transferring the developed electrostatic image to a substrate. Optionally, the transferred image can be permanently affixed to the substrate. Development of the image may be achieved by a number of methods, such as cascade, touchdown, powder cloud, magnetic brush, and the like. Transfer of the developed image to a substrate, such as paper, may be by any method, including those making use of a corotron or a biased roll. The fixing step may be performed by means of any suitable method, such as flash fusing, heat fusing, pressure fusing, vapor fusing, and the like. Any substrate selected for xerographic copiers and printers, including digital copiers, may be used as a substrate, such as paper, transparency, and the like.

Specific embodiments of the invention will now be described in detail. These Examples are intended to be illustrative, and the invention is not limited to the materials, conditions, or process parameters set forth in these embodiments, All parts and percentages are by weight unless otherwise indicated.

EXAMPLES

Example 1

Synthesis of Polymer (IIIa with x=0.95, y=0.05)

To a 5-liter round-bottomed flask is charged a mixture of 218.12 grams of 1,2,4,5-benzenetetracarboxylic dianhydride, 240.09 grams of 3-aminophenol and 2.5 liters of acetic acid, and the mixture is stirred at 110° C. for 6 hours. After the reaction mixture is cooled down to room temperature (25° C.), the resulting yellowish solid is collected by filtration and then stirred in 2.5 liters of methanol at room temperature (25° C.). After filtration, the solid material is collected by filtration, and recrystallized from dimethylformaldhyde to give, after drying in a vacuo for 48 hours at 150° C., 384 grams of bis(imidephenol) (Va) (95.9% isolated yield).

The resultant polymer is analyzed for its NMR and IR spectra. The results are as follows:

$^1$H-NMR ($CDCl_3$): δ8.8 (s, 2H), 8.2 (s, 2H), 3.6 (t, J=, 2H), 6.9 (m, 6H)

IR (KBr): 1702 and 1774 (C═O) $cm^{-1}$, 3451 and 3330 (OH) $cm^{-1}$.

A mixture of 2.002 grams of bis(imidephenol) (Va) as obtained above, 0.228 grams of benzyltriethylammonium chloride, 200 grams of 0.4% aqueous sodium hydroxide solution, 0.30 gram of tribultylamine and 85 milliliters of dichloromethane is mechanically stirred in a 2-liter flask equipped with a mechanical stir. A mixture of 21.63 grams of 4,4-cyclohexylbisphenol bischloroformate in 85 milliliters of methylene chloride is added slowly to the mixture. After the mixture is stirred at room temperature for 10 minutes, a slurry containing 10.73 grams of 4,4-cyclohexylbisphenol in 200 grams of 1.5% sodium hydroxide solution is added, and the pH of the reaction mixture is kept at around 12 with additional sodium hydroxide solution as needed. After being stirred for 4 hours, the reaction mixture is diluted with 300 milliliters of methylene chloride and transferred to a 2-liter separatory funnel and let to phase separate overnight. The organic layer is separated and added dropwise into 3 liters of stirring methanol. The precipitated polymer is collected by filtration and dried in vacuo at 60° C. overnight. The polymer product is then dissolved in 700 milliliters of methylene chloride, and again precipitated from 3 liters of methanol. The precipitated polymer product is washed with 2.5 liters of methanol, and dried in vacuo at 60° C. overnight to give 26 grams of IIIa (86% isolated yield).

The resultant polymer is analyzed for its IR spectrum and molecular weight. The results are as follows:

IR (film): 1775 and 1732 (C═O) $cm^{-1}$.

Mn: 30,000 and Mw: 133,000.

Example 2

Synthesis of Polymer (IIIa with x=0.90, y=0.10)

A mixture of 4.004 grams of bis(imidephenol) (Va), 0.228 grams of benzyltriethylammonium chloride, 100 grams of 1% aqueous sodium hydroxide solution, 0.30 gram of tribultylamine and 85 milliliters of dichloromethane is mechanically stirred in a 2-liter flask equipped with a mechanical stir. A solution of 23.60 grams of 4,4-cyclohexylbisphenol bischloroformate in 85 milliliters of methylene chloride is added slowly to the mixture. After the mixture is stirred at room temperature for 10 minutes, a slurry containing 8.05 grams of 4,4-cyclohexylbisphenol in 200 grams of 1.5% sodium hydroxide solution is added, and the pH of the reaction mixture is kept at around 12 with additional sodium hydroxide solution as needed. After being stirred for 4 hours, the reaction mixture is diluted with 300 milliliters of methylene chloride and transferred to a 2-liter separatory funnel and let to phase separate overnight. The organic layer is separated and added dropwise into 3 liters of stirring methanol. The precipitated polymer is collected by filtration and dried in vacuo at 60° C. overnight. The polymer product is then dissolved in 700 milliliters of methylene chloride, and again precipitated from 3 liters of methanol. The precipitated polymer product is washed with 2.5 liters of methanol, and dried in vacuo at 60° C. overnight to give 27 grams of IIIa (87.8% isolated yield).

The resultant polymer is analyzed for its NNR and IR spectra. The results are as follows:

IR (film): 1775 and 1732 (C═O) $cm^{-1}$.

Mn: 29,000 and Mw: 110,000.

Example 3

Synthesis of Poymer (IIIa with x=0.75, y=0.25)

A mixture of 10.009 grams of bis(imidephenol) (Va), 0.228 gram of benzyltriethylammonium chloride, 200 grams of 2% aqueous sodium hydroxide solution, 0.30 gram of tribultylamine and 85 milliliters of dichloromethane is mechanically stirred in a 2-liter flask equipped with a mechanical stir. A solution of 21.63 grams of 4,4-cyclohexylbisphenol bischloroformate in 85 milliliters of methylene chloride is added slowly to the mixture. After the mixture is stirred at room temperature for 10 minutes, a slurry containing 5.37 grams of 4,4-cyclohexylbisphenol in 100 grams of 1.5% sodium hydroxide solution is added, and the pH of the reaction mixture is kept at around 12 with additional sodium hydroxide solution as needed. After being stirred for 4 hours, the reaction mixture is diluted with 300 milliliters of methylene chloride and transferred to a 2-liter separatory funnel and let to phase separate overnight. The organic layer is separated and added dropwise into 3 liters of stirring methanol. The precipitated polymer is collected by filtration and dried in vacuo at 60° C. overnight. The polymer product is then dissolved in 700 milliliters of methylene chloride, and again precipitated from 3 liters of methanol. The precipitated polymer product is washed with 2.5 liters of methanol, and dried in vacuo at 60° C. overnight to give 26.0 grams of IIIa (79.5% isolated yield).

The resultant polymer is analyzed for its NMR and IR spectra. The results are as follows:

IR (film): 1775 and 1732 (C═O) $cm^{-1}$.

Mn: 30,000 and Mw: 89,000.

Example 4

Synthesis of Polymer (IIIc with x=0.75, y=0.25)

A mixture of 1.121 gram of bis(imidephenol) (Vc), 0.0228 gram of benzyltriethylammonium chloride, 22 grams of 2% aqueous sodium hydroxide solution, 0.01 gram of tribultylamine and 30 milliliters of dichloromethane is mechanically stirred in a 500-milliliter flask equipped with a mechanical stir. A solution of 2.16 grams of 4,4-cyclohexylbisphenol bischloroformate in 30 milliliters of methylene chloride is added slowly to the mixture. After the mixture is stirred at room temperature for 10 minutes, a slurry containing 0.54 grams of 4,4-cyclohexylbisphenol in 10 grams of 1.5% sodium hydroxide solution is added, and the pH of the reaction mixture is kept at around 12 with additional sodium hydroxide solution as needed. After being stirred for 4 hours, the reaction mixture is diluted with 60 milliliters of methylene chloride and then transferred to a 500-milliliter separatory funnel and let to phase separate overnight. The organic layer is separated and added dropwise to 1 liter of stirring methanol. The precipitated polymer is collected by filtration and dried in vacuo at 60° C. overnight. The polymer is dissolved in 120 milliliters of methylene chloride and again precipitated from 1 liter of methanol. The precipitated polymer is washed with 1 liter of methanol, and dried in vacuo at 60° C. overnight to give 2.6 grams of IIIa (73.4% isolated yield).

The resultant polymer is analyzed for its NMR and IR spectra. The results are as follows:

IR (film): 1775 and 1732 (C═O) $cm^{-1}$.

Mn: 28,000 and Mw: 100,000.

Example 5

An illustrative photoresponsive imaging device of the present invention is fabricated as follows.

A charge blocking layer is fabricated from a coating solution consisting of 54 weight percent of n-butanol, 2.6 wt % of polyvinyl butnone, 38.2 weight percent of Zirconium butoxide and 5.2 weight percent of gamma-aminopropylsilane. An aluminum drum substrate of 30 mm in diameter is dip-coated from a dip-coating tank containing the coating solution at a pull rate of 120 mm per min and dried at a temperature of 120° C. for 30 minutes. The resulting dry blocking layer has a thickness of about 0.1 micrometers. A charge generator coating dispersion is prepared by dispersing 22 grams of 0.4-micrometer chlorogallium phthalocyanine particles in a solution of 10 grams VMCH (available from Union Carbide Co.) in 368 grams of 1:1 mixture of xylene and n-butanol by weight. This dispersion is milled in a Dynomill mill (KDL, available from GlenMill) with 0.4-micrometer zirconium balls for 4 hours. The drum with the charge blocking layer then is dip-coated with the charge generator coating dispersion at a pull rate of 20 cm per minute. The resulting coated drum is air dried to form a 0.5-micrometer thick charge generating layer. A charge transport layer coating solution is prepared from 40 grams of N,N'-diphenyl-N,N'-bis(3-methylphenyl)-[1,1'-biphenyl]-4,4'-diamine and 60 grams of poly(imidecarbonate) (IIIa) of Example I dissolved in a solvent mixture comprising of 80 grams of monochlorobenzene and 320 grams of tetrahydrofuran. The charge transport coating solution is applied onto the coated drum by similar dip-coating procedure at a pull rate of 150 cm per second. The coated drum is dried at 110° C. for 20 minutes to form a 24-micrometer thick charge transport layer.

For comparison, a reference imaging device is prepared in the same manner by substituting poly(imide-carbonate) with polycarbonate Z (PCZ 400 available from Mitsubishi Chemical Co.) as the transport layer binder.

The xerographic electrical properties of the imaging member are determined by electrostatically charging its surface with a corona discharging device in the dark until the surface potential, as measured by a capacitively coupled probe attached to an electrometer, attains an initial value ($V_o$) of about 800 volts. After resting for 0.5 second in the dark, the charged member reaches a certain surface potential referred to as dark development potential ($V_{ddp}$), and is then exposed to light from a filtered xenon lamp. A reduction in the surface potential to a background potential ($V_{bg}$) due to photodischarge effect is observed. The dark decay in volt/second is calculated as $(V_o-V_{ddp})/0.5$. The percent photodischarge is calculated as $100\% \times(V_{ddp}-V_{bg})/V_{ddp}$. The light energy used to photodischarge the imaging member during the exposure step is measured with a light meter. The photosensitivity of the imaging member can be described in terms of $E_{1/2}$, amount of exposure energy in erg/cm$^2$ required to achieve 50 percent photodischarge from the dark development potential. The higher the photosensitivity, the smaller the $E_{1/2}$ value. High charge acceptance, low dark decay, and high photosensitivity (lower $E_{1/2}$ value) are desired for the improved performance of xerographic imaging members.

An illustrative wear test on the drum photoreceptor device of the present invention is carried out as follows.

The photoreceptor wear is determined by the difference in the thickness of photoreceptor before and after the wear test. For the thickness measurement, the photoreceptor is mounted onto the sample holder to zero the permascope at the uncoated edge of the photoreceptor. Then its thickness is measured at every one-inch interval from the top edge of the coating along its length using a permascope, ECT-100, to obtain an average thickness value. For the wear test, the photoreceptor drum is mounted in the xerographic customer replacement unit (CRU) and set into the wear test fixture for 100,000-cycle wear test. The wear test fixture is consisted of a CRU, power supplies for BCR, development roll (DR), a LED for light exposure, and a control unit to control the charging times of BCR, DR and LED and the rotation of the photoreceptor test device. The CRU consists of a photoreceptor, cleaning blade, a BCR, a DR, and a toner cartridge. The timing is set such that the photoreceptor is rotated for 10 cycles in 8 seconds and off (stop the rotation) for 1 second. During the 10-cycle rotation, the BCR is powered with a 2100 volt peak to peak AC voltage with a −450 volt DC bias. The DR is on for 300 msec after the BCR charging was on. The LED is turned on for 500 msec, 2 sec after the DR is turned on. Therefore for each 10-cycle run, the photoreceptor is charged to −450 V surface voltage for close to 8 seconds and developed with black toners, and then cleaned with a blade. The 10-cycle experiment is repeated for 10,000 times such that the photoreceptor is subject to a total of 100,000 cycles in the wear fixture.

The following table summarizes the electrical and wear test results of the experimental imaging device. The exposure light used is at a wavelength of 620 or 500 nanometers.

| Device | Vddp (V) | $E_{1/2}$ Ergs/cm$^2$ | Dark Decay (V per 500 ms) | Vr (V) | Wear (nm/kcycles) |
|---|---|---|---|---|---|
| Control Device with PCZ CTL binder | 800 | 1.83 | 16.8 | 4.7 | 60–100 |
| Device with poly(imidecarbonate) CTL binder | 800 | 1.80 | 16.8 | 7.3 | 40–60 |

CTL = Charge transport layer
Vr = residual voltage

Example 7

A photoresponsive imaging device incorporating a charge transport layer using poly(imide-carbonate) binder (IIIa) of Example II as the binder is prepared in accordance with the procedure of Example V. The following table summarizes the electrical and wear test performance of this device:

| Device | Vddp (V) | $E_{1/2}$ Ergs/cm$^2$ | Dark Decay (V per 500 ms) | Vr (V) | Wear (nm/k cycles) |
|---|---|---|---|---|---|
| Control Device PCZ CTL binder | 800 | 1.83 | 32.4 | 4.7 | 60–100 |
| Device with poly(imidecarbonate) CTL binder | 800 | 1.63 | 37.9 | 4.9 | 30–50 |

Example 8

A photoresponsive imaging device incorporating a charge transport layer using poly(imide-carbonate) binder (IIIa) of Example III as the binder is prepared in accordance with the procedure of Example V. The following table summarizes the electrical and wear test performance of this device:

| Device | Vddp (V) | $E_{1/2}$ Ergs/cm$^2$ | Dark Decay (V per @ 500 ms) | Vr (V) | Wear (nm/k cycles) |
|---|---|---|---|---|---|
| Control Device PCZ CTL binder | 800 | 1.83 | 32.4 | 4.7 | 60–100 |
| Device with poly(imidecarbonate) CTL binder | 800 | 2.03 | 29.8 | 4.1 | 20–40 |

All the imaging members of the present invention exhibit high charge acceptance levels, low dark decay ranging from about 4 to 25 volts per second, and high photosensitivities with $E_{1/2}$ ranging from about less than 3 ergs/cm$^2$ to about 15 ergs/cm$^2$. The devices also display enhanced wear resistance when compared to the control PCZ devices.

Other embodiments and modifications of the present invention may occur to those skilled in the art subsequent to a review of the information presented herein. These embodiments, modifications, and equivalents thereof, are also included within the scope of the present invention.

While the invention has been described in conjunction with the specific embodiments described above, it is evident that many alternatives, modifications and variations are apparent to those skilled in the art. Accordingly, the preferred embodiments of the invention as set forth above are intended to be illustrative and not limiting. Various changes can be made without departing from the spirit and scope of the invention.

What is claimed is:

1. A photoconductive imaging member comprising:

a photogenerating layer; and a charge transport layer, wherein the charge transport layer contains charge transport components and a poly(imide-carbonate) binder of general structure (I) or general structure (II):

(I)

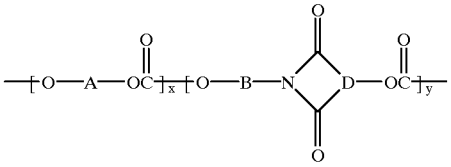

(II)

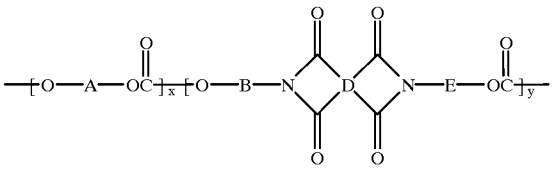

wherein A, B, and E are divalent linkages; D is a trivalent linkage in (I) and a tetravalent linkage in (II); and x and y are the mole fractions of the repeating units such that x+y is equal to 1, and wherein y represents a mole fraction to 25 mole percent.

2. A photoconductive imaging member in accordance with claim 1 wherein A, B and E are independently selected from the group consisting of alkylene, arylene, diarylene, alkylenearyl, bis(arylene)alkane, and bis(arylene)sulfide; and D is a trivalent aromatic linkage in (I) and a tetravalent aromatic linkage in (II) selected from the following:

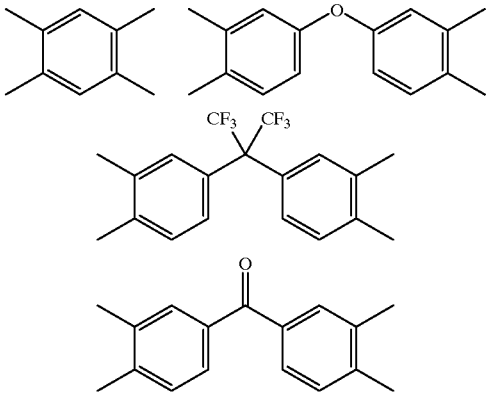

-continued

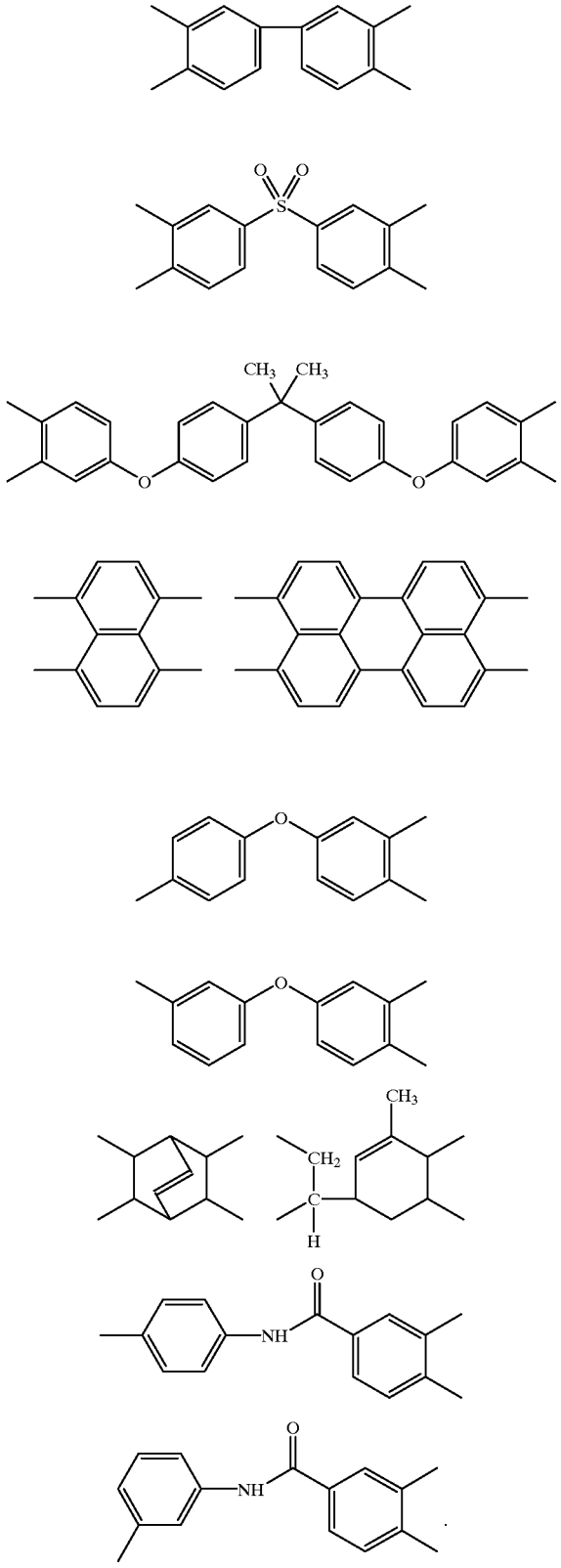

3. A photoconductive imaging member in accordance with claim 1, wherein the poly(imide-carbonate) binder is represented by the general structure (III):

(III)

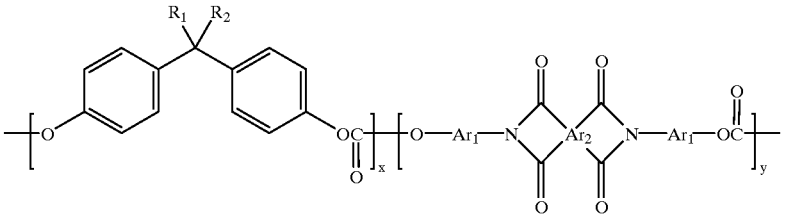

wherein $R_1$ and $R_2$ are independently selected from the group consisting of hydrogen, alkyl, substituted alkyl, aryl, and substituted aryl; Ar, is arylene or substituted arylene; $Ar_2$ is a tetravalent aromatic linkage such as monocyclic moiety derived from pyromellitic acid, or bicyclic moiety derived from biaryl-, benzophenone-, diarylsulfide, diaryl sulfone tetracarboxylic acids, or the like; and x and y are mole fractions of the repeating units such that x+y is equal to 1.

4. A photoconductive imaging member in accordance with claim 3, wherein $R_1$ and $R_2$ are alkyl containing from about 1 to about 10 carbon atoms.

5. A photoconductive imaging member in accordance with claim 3, wherein $Ar_1$ and $Ar_2$ are arylene groups containing from about 6 to about 30 carbon atoms.

6. A photoconductive imaging member in accordance with claim 5, wherein $Ar_1$ is selected from the group consisting of the following:

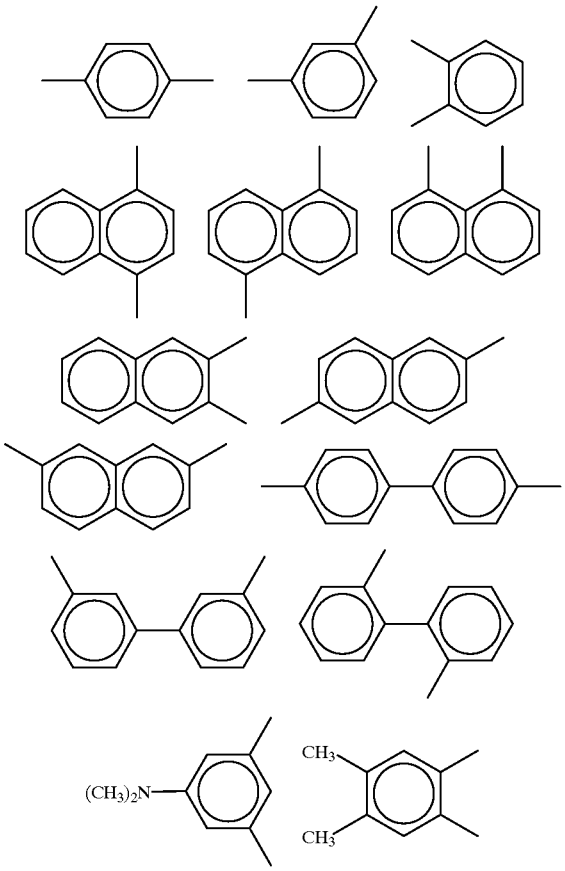

-continued

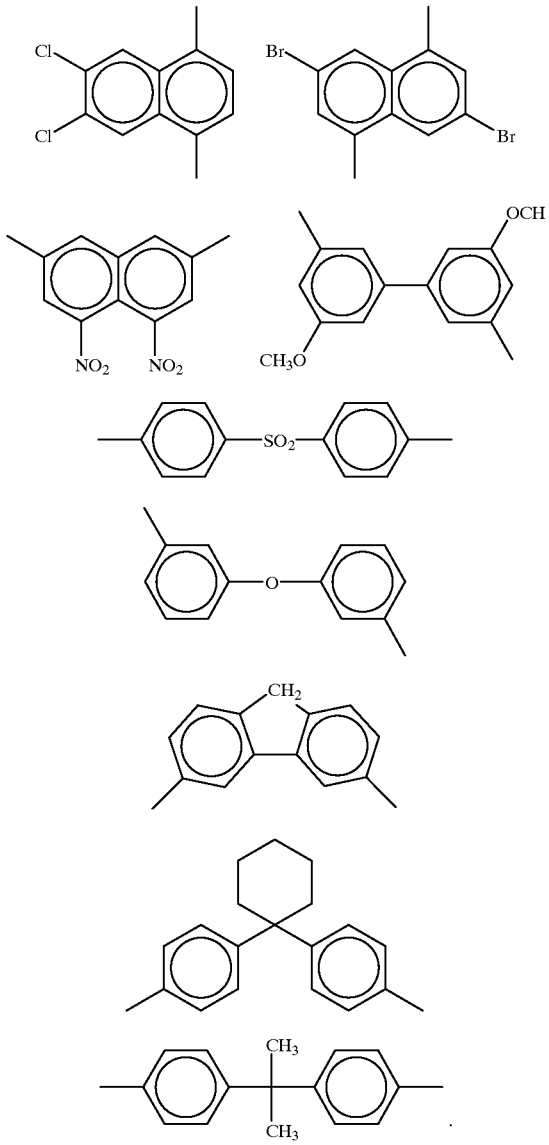

7. A photoconductive imaging member in accordance with claim 1, wherein said poly(imide-carbonate) is selected from the group consisting of the following structures (IIIa) through (IIIj):

(IIIa)
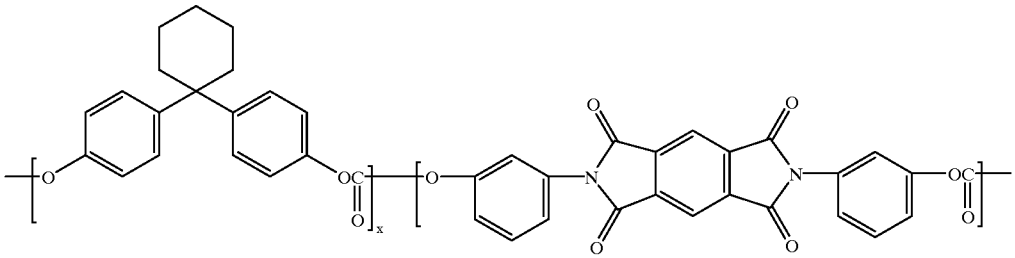
(IIIb)
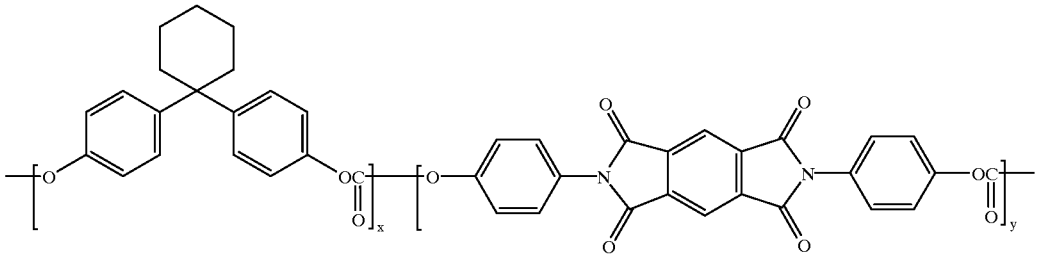
(IIIc)
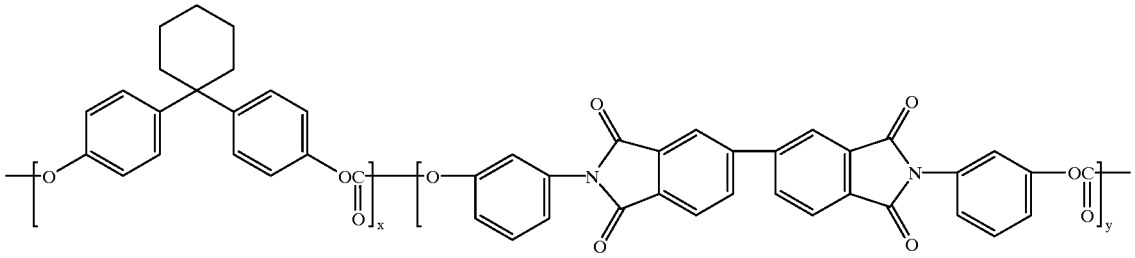
(IIId)
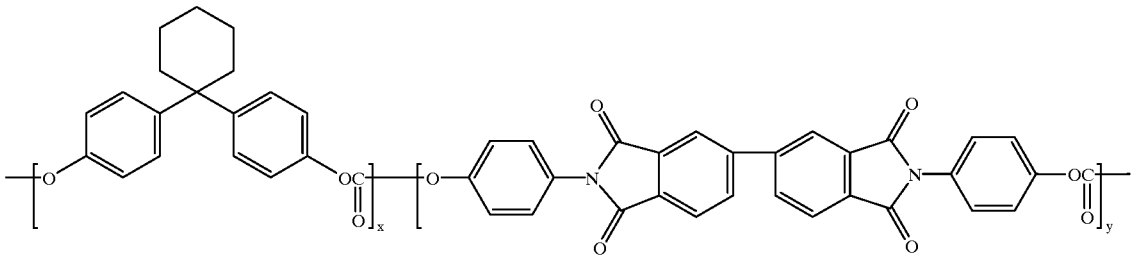
(IIIe)
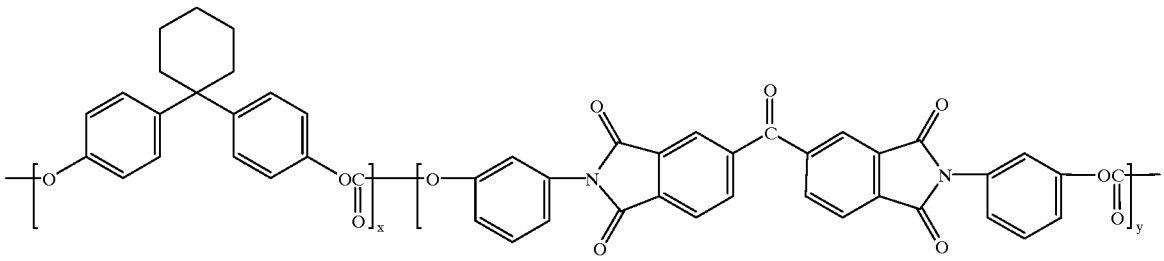

-continued
(IIIf)
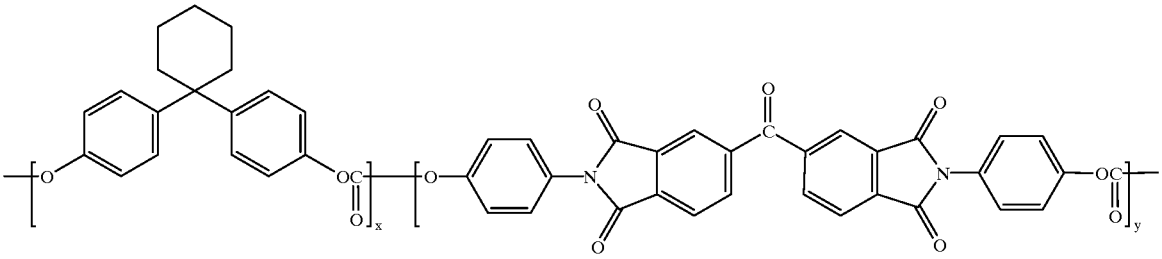
(IIIg)
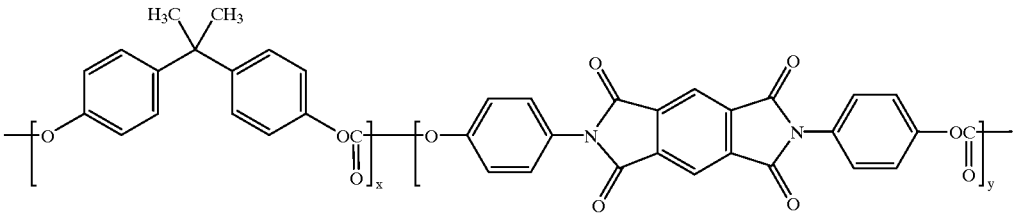
(IIIh)
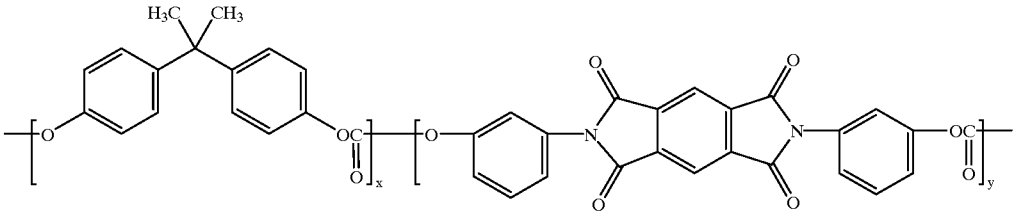
(IIIi)
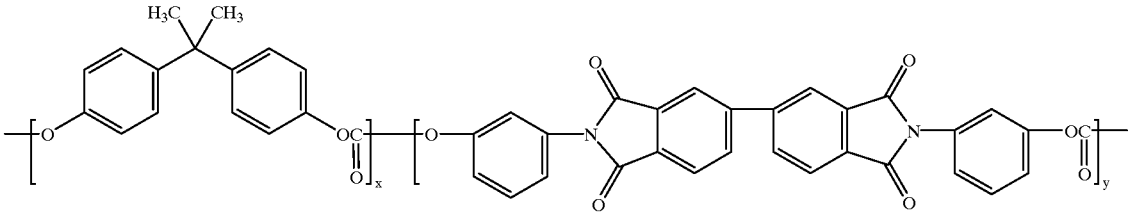
(IIIj)
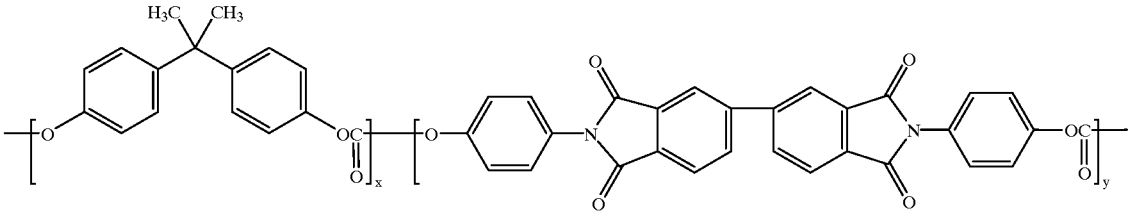

wherein x and y are mole fractions of the repeating units such that x+y is equal to 1.

8. A photoconductive imaging member in accordance with claim 7, wherein said poly(imide-carbonate) is selected from the group consisting of the structures (IIIa), (IIIb), (IIIc), (IIId), and (IIIe).

9. A photoconductive imaging member in accordance with claim 7, wherein said poly(imide-carbonate) is selected from the group consisting of the structures (IIIf), (IIIg), (IIIh), (IIIi), and (IIIj).

10. A photoconductive imaging member in accordance with claim 1, wherein said poly(imide-carbonate) is present in an amount of from about 20 to about 80 weight percent by weight of the charge transport layer.

11. A photoconductive imaging member in accordance with claim 1, wherein said poly(imide-carbonate) is present in an amount of from about 40 to about 65 weight percent by weight of the charge transport layer.

12. A photoconductive imaging member in accordance with claim 1, wherein said poly(imide-carbonate) is of the formula:

(IIIa)

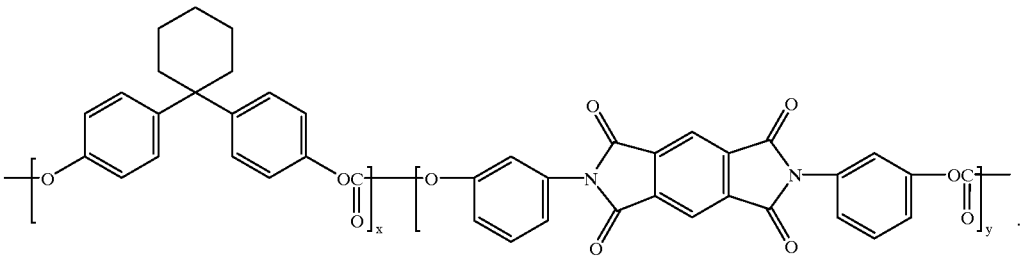

13. A photoconductive imaging member in accordance with claim 3, wherein said poly(imide-carbonate) possesses

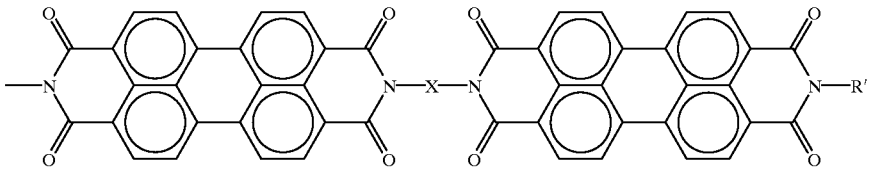

a weight average molecular weight, Mw, of form about 30,000 to about 500,000.

14. A photoconductive imaging member in accordance with claim 3, wherein said poly(imide-carbonate) possesses a number average molecular weight, Mn, of form about 10,000 to about 100,000.

15. A photoconductive imaging member in accordance with claim 7, wherein said poly(imide-carbonate) is selected from the group consisting of the structures (IIIa), (IIIb), and (IIIc).

16. A photoconductive imaging member in accordance with claim 1, wherein said photogenerating layer comprises photogenerating pigments.

17. A photoconductive imaging member in accordance with claim 16, wherein said photogenerating pigments are selected from the group consisting of metal free phthalocyanines, perylenes, titanyl phthalocyanines, selenium, and hydroxygallium phthalocyanines.

18. A photoconductive imaging member in accordance with claim 16, wherein said photogenerating pigments are dispersed in a resin binder.

19. A photoconductive imaging member in accordance with claim 18, wherein said binder is a polycarbonate.

20. A photoconductive imaging member in accordance with claim 18, wherein said binder is a poly(imide-polycarbonate).

21. A photoconductive imaging member in accordance with claim 16, wherein said photogenerating pigments comprise a perylene of the formula:

wherein each R and R' are independently selected from the group consisting of hydrogen, alkyl, substituted alkyl, aryl, and substituted aryl, and X represents a bridging linkage.

22. A photoconductive imaging member in accordance with claim 21, wherein X is selected from the group consisting of alkylene, substituted alkylene, arylene, and substituted arylene.

23. A photoconductive imaging member in accordance with claim 1, further comprising a supporting substrate in contact with the photogenerating layer.

24. A photoconductive imaging member in accordance with claim 1, further comprising a supporting substrate in contact with the charge transport layer.

25. A photoconductive imaging member in accordance with claim 24, wherein the supporting substrate is a metal, a conductive polymer, or an insulating polymer, wherein the supporting substrate has a thickness of from about 30 microns to about 300 microns, and wherein the supporting substrate is optionally overcoated with an electrically conductive layer with a thickness of from about 0.01 micron to about 1 micron.

26. A photoconductive imaging member in accordance with claim 1, further comprising an overcoating polymer top layer on said member.

27. A photoconductive imaging member in accordance with claim 1, wherein the photogenerator layer component is dispersed in a resinous binder in an amount of from about 5 percent to about 95 percent by weight.

28. A photoconductive imaging member in accordance with claim 27, wherein the resinous binder is selected from the group consisting of a polyester, a polyvinylcarbazole, a polyvinylbutyral, a polycarbonate, a polyethercarbonate, an aryl amine polymer, a styrene copolymer, and a phenoxy resin.

29. A photoconductive imaging member in accordance with claim 1, wherein the charge transport layer comprises aryl amines dispersed in the poly(imide-carbonate) binder.

30. A photoconductive imaging member in accordance with claim 1, wherein said charge transport layer is comprised of molecules of the following formula dispersed in the poly(imide-carbonate) binder:

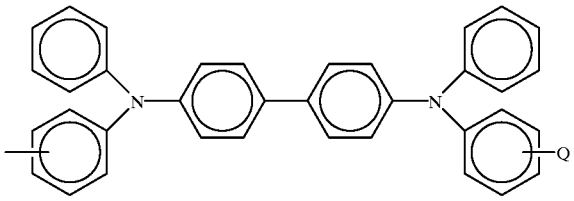

wherein Q is independently halo or alkyl.

31. A photoconductive imaging member in accordance with claim 30, wherein the charge transport layer is comprised of said aryl amine molecules dispersed in said poly (imide-carbonate) in an amount of from about 20 to about 60 percent by weight of the charge transport layer.

32. A photoconductive imaging member in accordance with claim 1, wherein the photogenerating layer has a thickness of from about 0.2 to about 10 microns, and wherein the charge transport layer has a thickness of from about 10 to about 100 microns, and further comprising a supporting substrate overcoated with a polymeric adhesive layer of a thickness of from about 0.01 to about 1 micron.

33. An imaging method comprising:

forming a latent image on the photoconductive imaging member of claim 1, developing the image with a toner composition comprising resin and colorant, transferring the image to a substrate, and optionally fixing the image to the substrate.

34. A photoconductive imaging member in accordance with claim 1, wherein y represents a mole fraction of at least 10 mole percent.

* * * * *